US008840229B2

(12) United States Patent
Piatt et al.

(10) Patent No.: US 8,840,229 B2
(45) Date of Patent: Sep. 23, 2014

(54) CONTINUOUS INKJET PRINTING SYSTEM AND METHOD FOR PRODUCING SELECTIVE DEFLECTION OF DROPLETS FORMED FROM TWO DIFFERENT BREAK OFF LENGTHS

(71) Applicants: Michael Joseph Piatt, Dayton, OH (US); Randy Lee Fagerquist, Fairborn, OH (US)

(72) Inventors: Michael Joseph Piatt, Dayton, OH (US); Randy Lee Fagerquist, Fairborn, OH (US)

(73) Assignee: Eastman Kodak Company, Rochester, NY (US)

( * ) Notice: Subject to any disclaimer, the term of this patent is extended or adjusted under 35 U.S.C. 154(b) by 68 days.

(21) Appl. No.: 13/848,769

(22) Filed: Mar. 22, 2013

(65) Prior Publication Data

US 2013/0278682 A1 Oct. 24, 2013

Related U.S. Application Data

(62) Division of application No. 12/187,593, filed on Aug. 7, 2008.

(51) Int. Cl.
*B41J 2/02* (2006.01)

(52) U.S. Cl.
USPC ..... 347/77; 347/73

(58) Field of Classification Search
USPC ..... 347/73, 77
See application file for complete search history.

(56) References Cited

U.S. PATENT DOCUMENTS

| | | | |
|---|---|---|---|
| 3,709,432 | A | 1/1973 | Robertson |
| 4,318,481 | A | 3/1982 | Lombardo et al. |
| 4,321,609 | A | 3/1982 | Fidler et al. |
| 4,338,613 | A | 7/1982 | Cruz-Uribe |
| 4,346,387 | A | 8/1982 | Hertz |
| 4,364,057 | A | 12/1982 | Ebi et al. |
| 4,596,990 | A | 6/1986 | Hou |
| 4,638,328 | A | 1/1987 | Drake et al. |
| 4,839,665 | A | 6/1989 | Hertz et al. |
| 5,001,497 | A | 3/1991 | Wills et al. |
| 5,070,341 | A | 12/1991 | Willis et al. |
| 5,434,609 | A | 7/1995 | Rhodes |
| 5,489,929 | A | 2/1996 | Vago |
| 5,491,362 | A | 2/1996 | Hamzehdoost et al. |
| 6,012,805 | A | 1/2000 | Hawkins et al. |
| 6,109,739 | A | 8/2000 | Stamer et al. |
| 6,217,163 | B1 | 4/2001 | Anagnostopoulos et al. |

(Continued)

FOREIGN PATENT DOCUMENTS

EP 0 521 764 6/1995

*Primary Examiner* — Kevin S Wood
(74) *Attorney, Agent, or Firm* — William R. Zimmerli

(57) ABSTRACT

A continuous inkjet method includes modulating a liquid jet having a wavelength λ, and causing first and second droplets to break off from the liquid jet and travel along a path. The second droplet has a break off length that is longer than the break off length of the first droplet. The first and second break off lengths have a difference of at least one wavelength λ in response to stimulation pulses. A charge differential is produced between the first and second droplets. The trajectories of the first and second droplets are caused to diverge so that one of the first and second droplets is collected and the other of the first and second droplets is deposited on a surface. A transition in droplet creation is identified between stimulation cycles that produce the first and second droplets. A skip cycle is introduced between the stimulation cycles.

9 Claims, 16 Drawing Sheets

(56) References Cited

U.S. PATENT DOCUMENTS

| | | | | |
|---|---|---|---|---|
| 6,247,801 | B1 | 6/2001 | Trauernicht et al. | |
| 6,273,559 | B1 | 8/2001 | Vago et al. | |
| 6,508,532 | B1 | 1/2003 | Hawkins et al. | |
| 6,509,917 | B1 | 1/2003 | Chwalek et al. | |
| 6,520,629 | B1 | 2/2003 | Sharma et al. | |
| 7,938,516 | B2 * | 5/2011 | Piatt et al. | 347/73 |
| 2003/0085964 | A1 | 5/2003 | Long | |
| 2004/0263585 | A1 | 12/2004 | Jeanmaire | |
| 2007/0064067 | A1 | 3/2007 | Katerberg | |
| 2010/0033543 | A1 * | 2/2010 | Piatt et al. | 347/77 |

* cited by examiner

CONTINUOUS INKJET PRINTING SYSTEM AND METHOD FOR PRODUCING SELECTIVE DEFLECTION OF DROPLETS FORMED FROM TWO DIFFERENT BREAK OFF LENGTHS

CROSS REFERENCE TO RELATED APPLICATIONS

This is a divisional application of U.S. application Ser. No. 12/187,593 filed Aug. 7, 2008.

Reference is made to commonly assigned U.S. Pat. No. 7,938,516 filed in the name of Piatt et al and entitled "Continuous Inkjet Printing System and Method for Producing Selective Deflection of Droplets Formed During Different Phases of a Common Charge Electrode" and filed concurrently herewith.

FIELD OF THE INVENTION

The present invention relates to the field of continuous inkjet printing systems and methods. Specifically, the invention is for an apparatus and method for selectively generating droplets using different break off lengths and selectively deflecting droplets formed by an inkjet printhead.

BACKGROUND OF THE INVENTION

Continuous inkjet (CIJ) printing systems create printed materials by forcing ink, under pressure, through a nozzle. The flow of ink may be disrupted in a manner such that the flow breaks up into droplets of ink in a predictable manner. Printing occurs through the selective deflecting and catching of undesired ink droplets. In U.S. Pat. No. 6,273,559 filed in the names of Vago et al. there are described continuous inkjet printing techniques one of which is referred to as the binary continuous inkjet technique. In the binary continuous inkjet technique electrically conducting ink is pressurized and discharged through a calibrated nozzle and the ink jets formed are broken off at two different time intervals. Droplets to be printed or not printed are created with periodic stimulation pulses at a nozzle. The droplets to be printed are each created with a periodic stimulation pulse that is relatively strong and causes the ink jet stream forming that droplet to separate at a relatively short break off length. The droplets that are not to be printed are each created with a periodic stimulation pulse that is relatively weak and causes the droplet to separate at a relatively long break off length. Electrodes are positioned just downstream of the nozzle and provide a charge to each droplet that is formed. The longer break off length droplets are selectively deviated from their path by a deflection device because of their charge and are deflected by the deflection device towards a catcher surface where they are collected in a gutter and returned to a reservoir for reuse.

The binary CIJ printheads may be operable in a manner such that the liquid jets may be said to have associated therewith a wavelength λ that is the distance between successive ink droplets or ink nodes in that liquid jet. The wavelength, λ, is equal to the speed of the jet divided by the frequency of the stimulation signals, assuming one stimulation signal at each nozzle during a stimulation cycle. It is thus possible to modulate the liquid jets break off points such that there exist a first and a second liquid break off points such that the break off points differ by a distance measured related to this wavelength. For example, in the aforementioned Vago et al. patent the longer and shorter break off length droplets have a distance between two jet break off points of less than λ. The longer break off length droplets have a break off point or droplet formation point d2 that is spaced from the location d1 where the shorter break off length droplets form by a distance less than λ. In Vago et al. there is mention made of prior art wherein the delta difference between d2 and d1 is λ and that this creates problems when there is a transition at a nozzle from creation of a longer break off length droplet followed by a shorter break off length droplet. The problem recognized by Vago et al. is that of the tendency of the longer break off length droplet and the shorter break off length droplet to simultaneously detach; i.e. two droplets break off from the jet concurrently. Where the delta difference is slightly greater than λ the two droplets may temporarily be combined and alter the trajectory of the droplets. There is thus the strong suggestion by Vago et al. to avoid the use of having droplet separation distance differences between the longer break off length droplets and shorter break off length droplets be greater than or equal to λ. To this end the specification of Vago et al. is directed to the teaching of using a significantly smaller break off separation distance between the longer break off length droplets and the shorter break off length droplets.

To enable droplet selection based on such small break off length differences as taught by Vago et al. it is necessary to establish electric fields having a sharp gradient along the jet trajectory. Vago et al. is able to achieve these high gradients by utilizing two sets of charge plates that were closely spaced along the drop trajectory. One of the electrode pairs was biased at +300 volts relative to the drop generator and the second electrode pair biased to −300 volts relative to the drop generator. To alter the break off length locations as described in the Vago et al. specification requires two stimulation amplitudes, a print and a non-print stimulation amplitude, to be employed. Limiting the break off length locations difference to less than λ restricts the stimulation amplitudes difference that must be used to a small amount. This amplitude control is quite easy to employ to separate print and nonprint droplets for a printhead that has only a single jet. However, in a printhead having an array of nozzles it is common for there to be variations in stimulation response from nozzle to nozzle so that different nozzles require different stimulation amplitudes to produce a particular break off length location. In an array of many nozzles, the variations in stimulation from nozzle to nozzle can exceed the difference in amplitude from long to short droplet break off locations for a jet. In such systems extra control complexity is required to adjust the stimulation amplitude from nozzle to nozzle while allowing a change in amplitude from a base level to produce the desired change in break off length.

It is therefore an object of the invention to overcome the aforesaid deficiencies by allowing the change in break off length from long break off length to short break off length to be greater than λ. This enables the use of less complex charge electrode structures and larger spacing between the charge electrode structures and the nozzles.

SUMMARY OF THE INVENTION

In accordance with a first aspect of the invention there is provided a continuous inkjet system for selectively depositing liquid droplets upon a surface, the system comprising a liquid chamber including a nozzle, the liquid chamber containing liquid under pressure sufficient to produce the liquid jet through the nozzle. A stimulation device operatively associated with the liquid jet. The stimulation device is operable to produce a modulation in the liquid jet having a wavelength λ and causes a first liquid droplet to break off from the liquid jet and travel along a path and causes a second liquid droplet to break off from the liquid jet and travel along the path. The first liquid droplet has a first break off length and the second liquid droplet has a second break off length longer than the first break off length. The first break off length and the second break off length have a difference of at least one wavelength λ in response to stimulation pulses received from a stimulation controller. A deflection mechanism includes a charge electrode associated with the path. The charge electrode is operable to produce a charge differential between the first liquid droplet and the second liquid droplet, and the deflection mechanism is operable to cause trajectories of the first liquid droplet and the second liquid droplet to diverge so that a trajectory of one droplet of the first and second liquid droplets causes the one droplet to be directed for collection and prevented from depositing on the surface and a trajectory of the other droplet of the first and liquid droplets causes the other droplet to be directed for depositing on the surface. A stimulation controller is provided for identifying a transition in droplet creation between a stimulation cycle that is to produce a droplet having a second break off length and a stimulation cycle that is to produce a droplet having a first break off length and introduces a skip cycle between the stimulation cycle that is to produce the droplet having the second break off length and the stimulation cycle that is to produce a droplet having the first break off length.

In accordance with a second aspect of the invention there is provided a continuous inkjet droplet generating method for selectively depositing liquid droplets upon a surface. The method comprises producing a liquid jet through a nozzle and operating a stimulation device associated with the liquid jet to produce, in response to stimulation pulses provided during stimulation cycles, a modulation in the liquid jet having a wavelength λ. A first liquid droplet is caused to break off from the liquid jet and travel along a path and a second liquid droplet is also caused to break off from the liquid jet and travel along the path. The first liquid droplet has a first break off length and the second liquid droplet has a second break off length longer than the first break off length. The first break off length and the second break off length have a difference of at least one wavelength λ. A deflection mechanism includes a charge electrode associated with the path. The charge electrode produces a charge differential between the first liquid droplet and the second liquid droplet, and the deflection mechanism selectively attracts or repulses ink droplets so that trajectories of the first liquid droplet and the second liquid droplet diverge so that a trajectory of one droplet of the first and second liquid droplets causes the one droplet to be directed for collection and prevented from depositing on the surface and a trajectory of the other droplet of the first and liquid droplets causes the other droplet to be directed for depositing on the surface. A transition in droplet creation is identified between a stimulation cycle that is to produce a droplet having a second break off length and a stimulation cycle that is to produce a droplet having a first break off length and a skip cycle is introduced between the stimulation cycle that is to produce the droplet having a second break off length and the stimulation cycle that is to produce the droplet having the first break off length.

These and other objects, features and advantages of the present invention will become apparent to those skilled in the art upon reading of the following detailed description when taken in conjunction with the drawings wherein there is shown and described illustrative embodiments of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
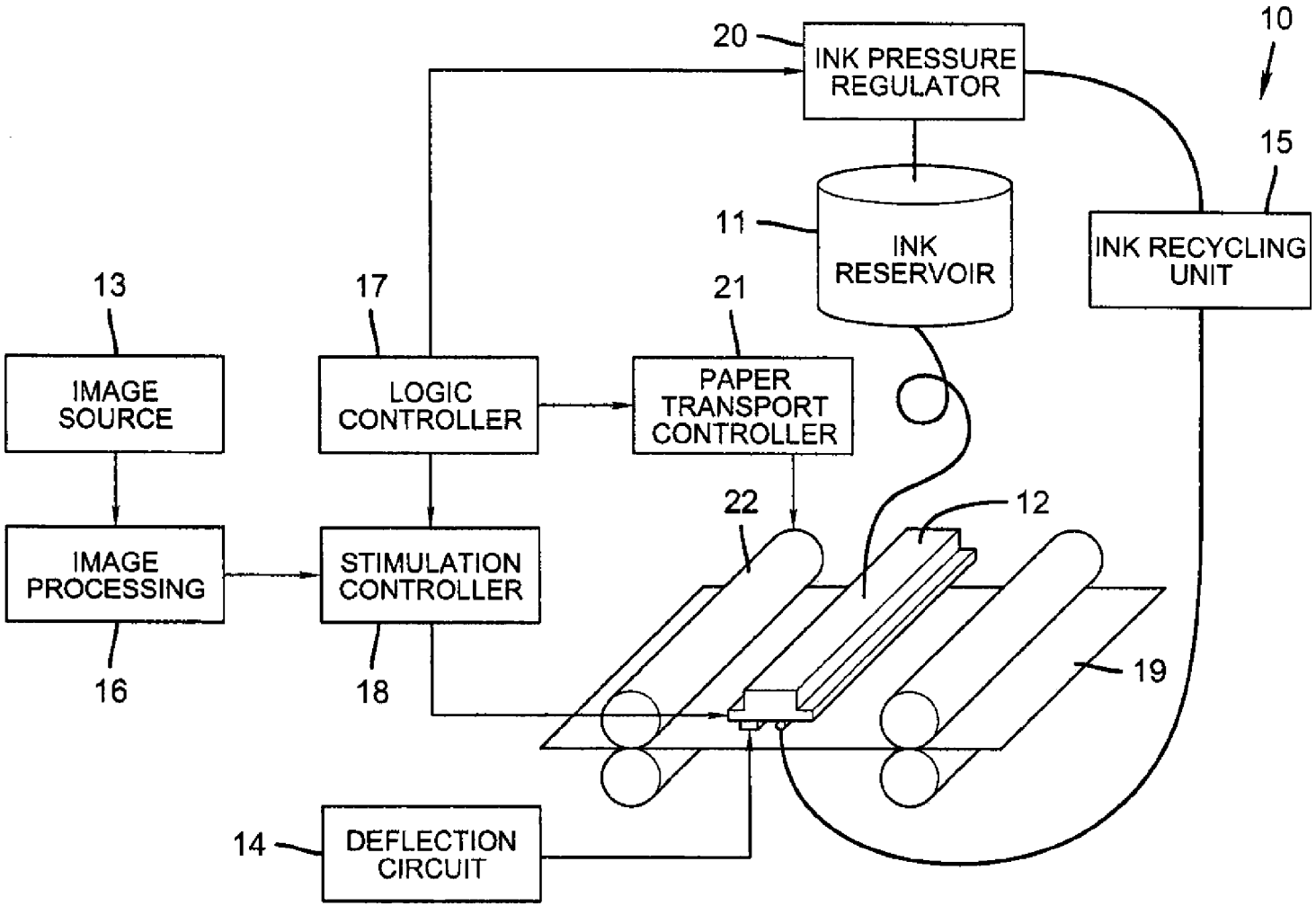
FIG. 1 is a simplified block schematic diagram of one exemplary continuous inkjet printing system according to the present invention.

A continuous inkjet printing system 10 as illustrated in FIG. 1 comprises an ink reservoir 11 that continuously pumps ink into a printhead 12 to create a continuous stream of ink droplets. Printing system 10 receives digitized image process data from an image source 13 such as a scanner, or digital camera or computer or other source of digital data which provides raster image data, outline image data in the form of a page description language, or other forms of digital image data. The image data from the image source 13 is sent periodically to an image processor 16. Image processor 16 processes the image data and includes a memory for storing image data. Image data in image processor 16 is stored in image memory in the image processor 16 and is sent periodically to a droplet or stimulation controller 18 which generates patterns of time-varying electrical stimulation pulses to cause a stream of droplets to form at the outlet of each of the nozzles on printhead 12, as will be described. The image processor 16 is typically a raster image processor (RIP). These stimulation pulses are applied at an appropriate time and at an appropriate frequency to stimulation device(s) associated with each of the nozzles. The printhead 12 and deflection mechanism 14 works sequentially in order to determine whether ink droplets are printed on a recording medium 19 in the appropriate position designated by the data in image memory or deflected and recycled via the ink recycling units 15. The ink in the ink recycling units 15 is directed back into the ink reservoir 11. The ink is distributed under pressure to the back surface of the printhead 12 by an ink channel that includes a chamber or plenum formed in a silicon substrate. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20.

One well-known problem with any type inkjet printer, whether drop-on-demand or continuous flow, relates to dot positioning. As is well-known in the art of inkjet printing, one or more droplets are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer droplets are intended to be placed in desired locations within each pixel, for example in the center of each pixel area, for simple printing schemes, or, alternatively, in multiple precise locations within each pixel areas to achieve half-toning. If the placement of the droplet is incorrect and/or their placement cannot be controlled to achieve the desired placement within each pixel area, image artifacts may occur, particularly if similar types of deviations from desired locations are repeated on adjacent pixel areas. The RIP or other type of processor 16 converts the image data to a pixel-mapped image page image for printing. During printing operation, a recording medium 19 is moved relative to printhead 12 by means of a plurality of transport rollers 22 which are electronically controlled by transport control system 21. A logic controller 17, preferably microprocessor based and suitably programmed as is well-known, provides control signals for cooperation of transport control system 21 with the ink pressure regulator 20 and stimulation controller 18. The stimulation controller 18 comprises a droplet controller that provides the drive signals for ejecting individual ink droplets from printhead 12 to recording medium 19 according to the image data obtained from an image memory forming part of the image processor 16. Image data may include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

It may be appreciated that different mechanical configurations for receiver transport control may be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18 which may be generally referred to as a droplet controller and are typically voltage pulses sent to the printhead 12 through electrical connectors, as is well-known in the art of signal transmission. However, the types of pulses, such as optical pulses, may also be sent to printhead 12, to cause printing and non-printing droplets to be formed at particular nozzles, as is well-known in the inkjet printing arts. Once formed, printing droplets travel through the air to a recording medium and later impinge on a particular pixel area of recording medium or are collected by a catcher as will be described.

Figure 2:
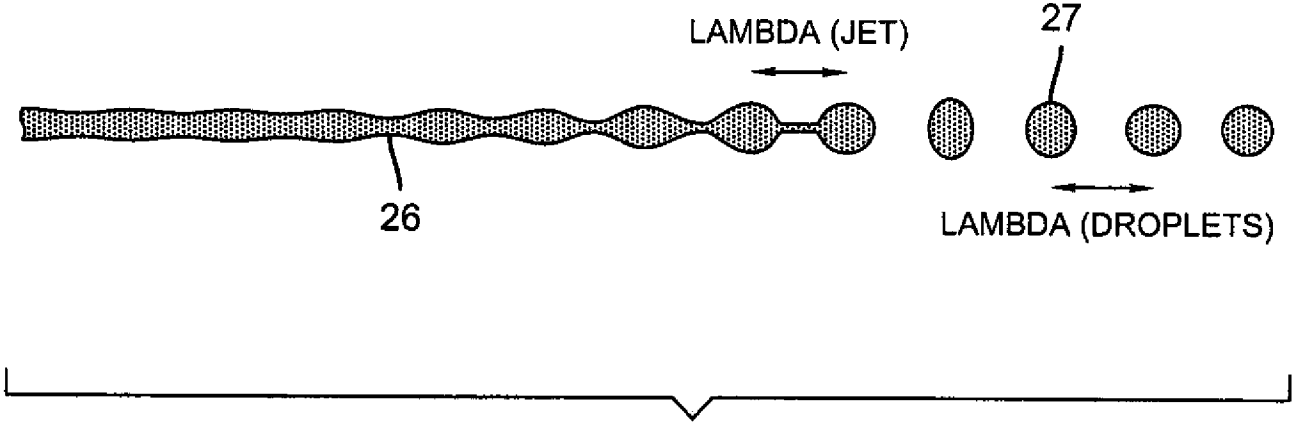
FIG. 2 is an illustration of a jet stream emanating from a nozzle of the continuous inkjet system of FIG. 1 and illustrating the definition of the wavelength, λ.

With reference now to FIG. 2 the printhead has associated with it, a drop generator that is operable to produce from an array of nozzles liquid jets 26, which break up into ink droplets 27 through the action of stimulation devices. The creation of the droplets is associated with an energy supplied by the stimulation device operating at a frequency that creates droplets separated by the distance $\lambda$, (each value of $\lambda$ is diagrammed by a line with two arrowheads). The stimulation for the liquid jet in FIG. 2 is controlled independently by a stimulation device associated with each liquid jet or nozzle. In one embodiment, the stimulation device comprises one or more resistive elements adjacent to the nozzle. In this embodiment, the liquid jet stimulation is accomplished by sending a periodic current pulse of arbitrary shape, supplied by the stimulation controller through the resistive elements surrounding each orifice of the droplet generator. The break off time of the droplet for a particular inkjet can be controlled by at least one of the amplitude or duty cycle, of the stimulation pulse to the respective resistive elements surrounding a respective resistive nozzle orifice. In this way, small variations of either pulse duty cycle or amplitude allow the droplet break off times to be modulated in a predictable fashion within +/−one-tenth the droplet generation period. As the fluid in the liquid jet move a distance $\lambda$ every drop generation period, these small variations of either pulse duty cycle or amplitude produce changes in the break off length, the distance from the orifice at which a drop separates from the liquid jet in a predictable fashion to within 1/10 of a distance $\lambda$.

Figure 3A:
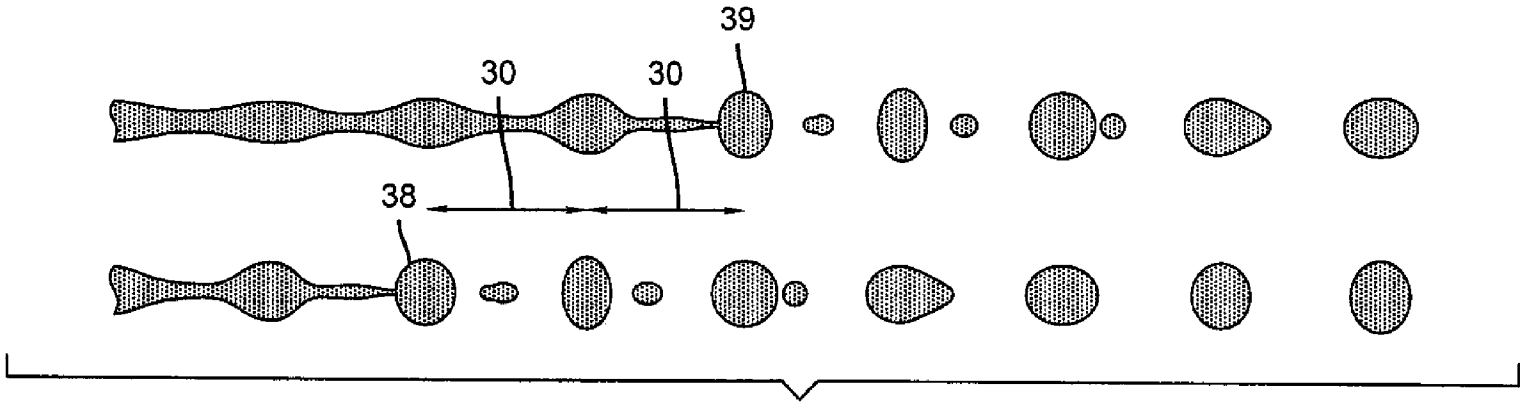
FIGS. 3A and 3B illustrate sample break off distances of short break off length droplets and long break off length droplets with a difference in their droplet lengths that are at least λ.
Figure 3B:
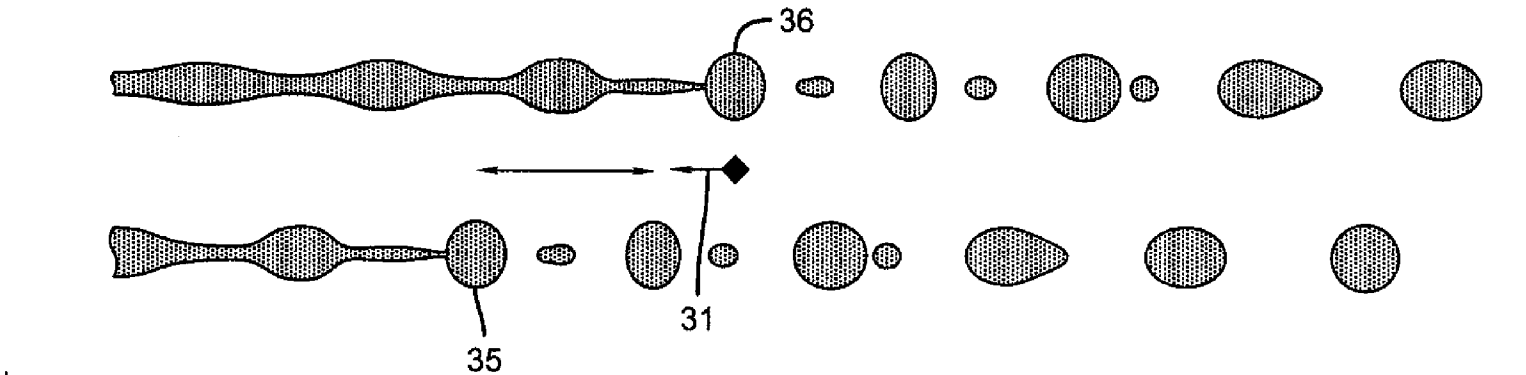

For this invention, the ability to select charging of droplets is dependent upon the creation of the jet differences of at least $\lambda$ in their droplet break off lengths. As for example, in FIG. 3A, the adjacent liquid jets have break off lengths differing by two values of $\lambda$ (or two arrows 30). That is, there is a $2\lambda$ distance difference from which droplet 38 breaks off as compared to the point where droplet 39 breaks off. In yet another example, FIG. 3B, the top jet has a longer break off point than the bottom jet. However, this time the distance is not an interval number of $\lambda$, as designated by the truncated arrows 31. Here the jets differ by 1.25λ as shown by the break off point of the droplet 35 compared to the point where droplet 36 breaks off.

Figure 4A:
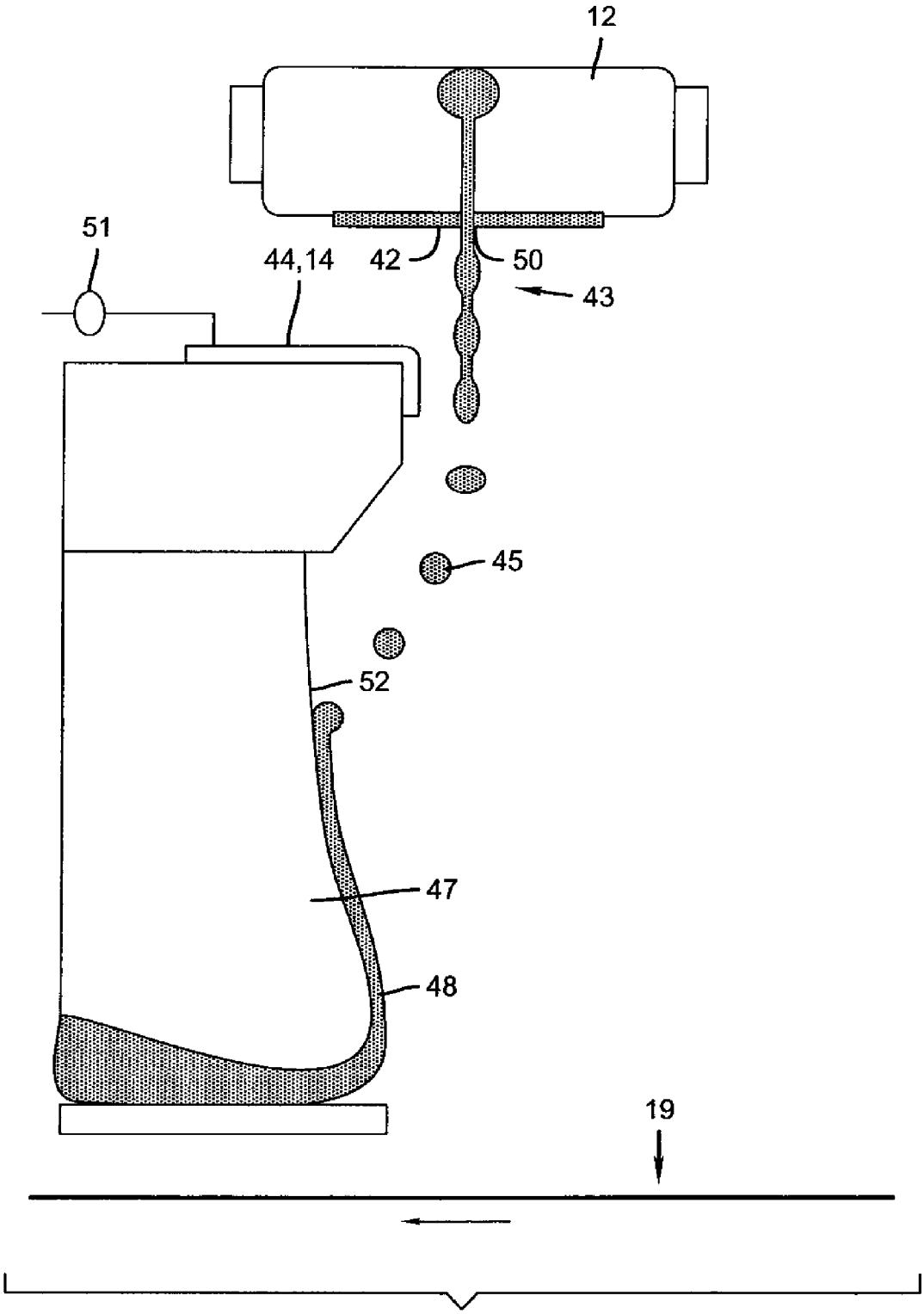
FIGS. 4A and 4B illustrate respectively a cross-sectional viewpoint through a single liquid jet of the continuous inkjet system with longer break off length droplets (FIG. 4A) and shorter break off length droplets (FIG. 4B) and illustrating, in this case, that the former are charged by a charge electrode and attracted to the catcher and are not printed and the latter are not charged and fall to the substrate and are printed.
Figure 4B:
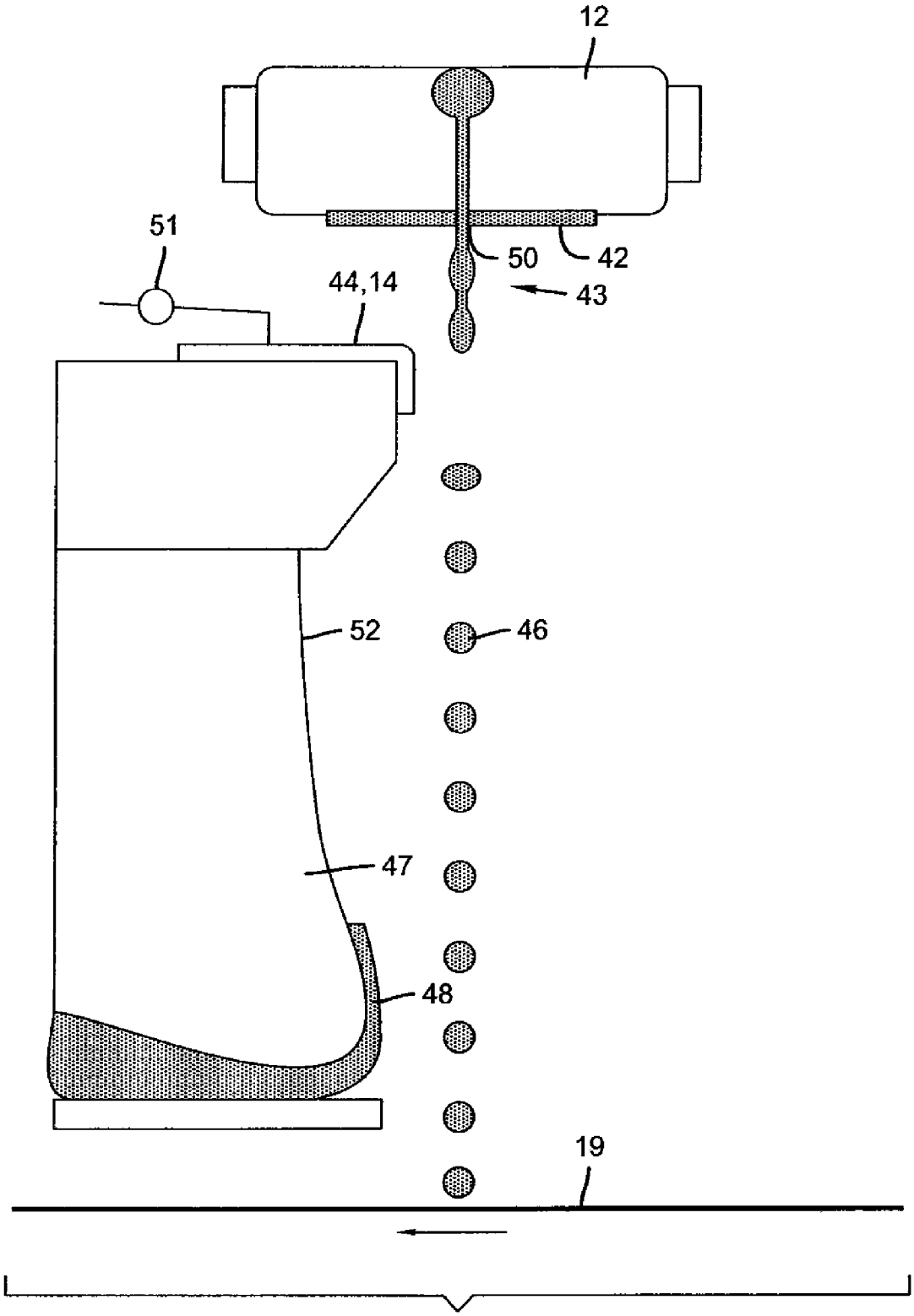

With reference now to FIGS. 4A and 4B, wherein the printhead 12 droplet generator or stimulation device 42 creates a liquid jet 43 that breaks up into ink droplets. Selection of droplets as print droplets 46 or non-print droplets 45 will depend upon the location of the fluid break off point relative to the charge electrode 44 that is part of the deflection mechanism 14. The charge electrode 44 is suitably continuously biased by an electrical potential source 51 relative to the printhead. When the liquid jet 43 breaks off into a droplet in front of the charge electrode 44 (as shown in FIG. 4A), the drop acquires a charge, is deflected by a deflection means towards the catcher 47 to form an ink film 48 on the face of the catcher. Deflection occurs when droplets break off the liquid jet in front of the charge electrode while the potential of the charge electrode 44 is provided with a voltage or electrical potential having a non-zero magnitude. An exemplary range of values of the electrical potential difference between a high level voltage on the charge electrode relative to a ground potential on the printhead is 50 to 200 volts and more preferably 90 to 150 volts. This high-level voltage may be negative or positive. The droplets will then acquire an induced electrical charge that remains upon the droplet surface. The charge on an individual droplet has a polarity opposite that of the charge electrode and a magnitude that is dependent upon the magnitude of the voltage and the capacity of coupling between the charge electrode and the droplet at the instant the droplet separates from the liquid jet. This capacity of coupling is dependent in part on the spacing between the charge plate and the droplet as it is breaking off. Once the charged droplets have broken away from the liquid jets, the droplets will travel in close proximity to the catcher face 52 which is typically constructed of a conductor or dielectric. The charges on the surface of the droplet will induce either a surface charge density charge (for the catcher constructed of a conductor) or a polarization density charge (for the catcher constructed of a dielectric). The induced charges in the catcher will have a distribution identical to a fictitious charge (opposite in polarity and equal in magnitude) in the distance in the catcher equal to the distance between the catcher and the droplet. These induced charges in the catcher are known in the art as an image charge. The force exerted on the charged ink droplet by the catcher face is equal to what would be produced by the image charge alone and causes the charged droplets to deflect and thus diverge from its path and accelerate along a trajectory towards the catcher face at a rate proportional to the square of the droplet charge and inversely proportional to the droplet mass. In this embodiment the charge distribution induced on the catcher comprises a portion of the deflection mechanism. In other embodiments, the deflection mechanism can include one or more additional electrodes to generate an electric field through which the charged droplets pass so as to deflect the charged droplets. For example, a single biased electrode in front of the upper grounded portion of the catcher can be used as shown in U.S. Pat. No. 4,245,226, or a pair of additional electrodes can be used as shown in U.S. Pat. No. 6,273,559.

In the alternative, when the liquid jet is operable such that the break off point is not in front of the charge electrode 44 (short of the charge electrode as shown in FIG. 4B) the droplet does not acquire a charge, travels along a trajectory which is generally on an undeflected path, and impacts the print substrate 19 as a print droplet 46.

Figure 5A:
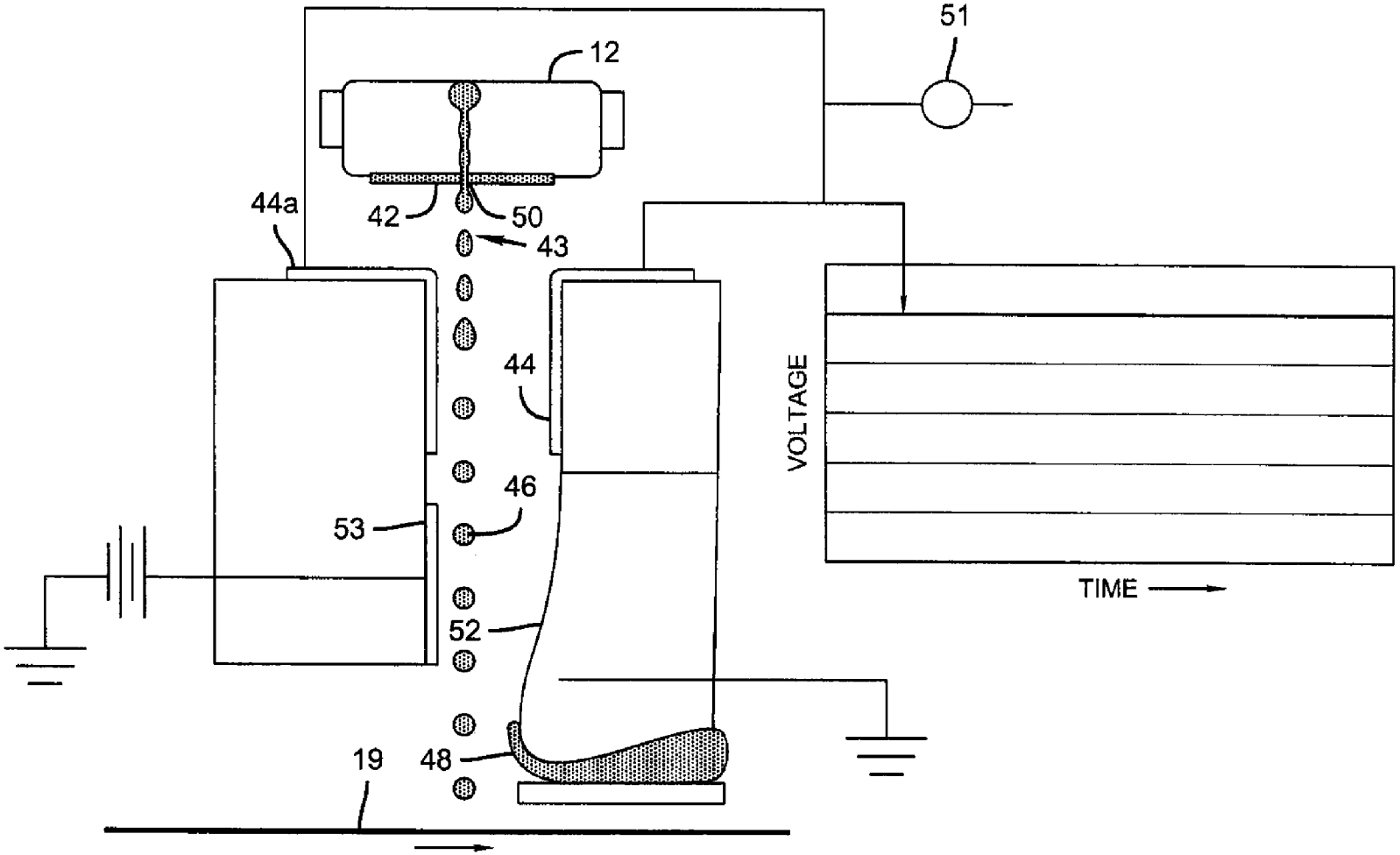
FIGS. 5A and 5B illustrate respectively another embodiment of a continuous inkjet system of the invention and showing a charge electrode that employs a counter-electrode.
Figure 5B:
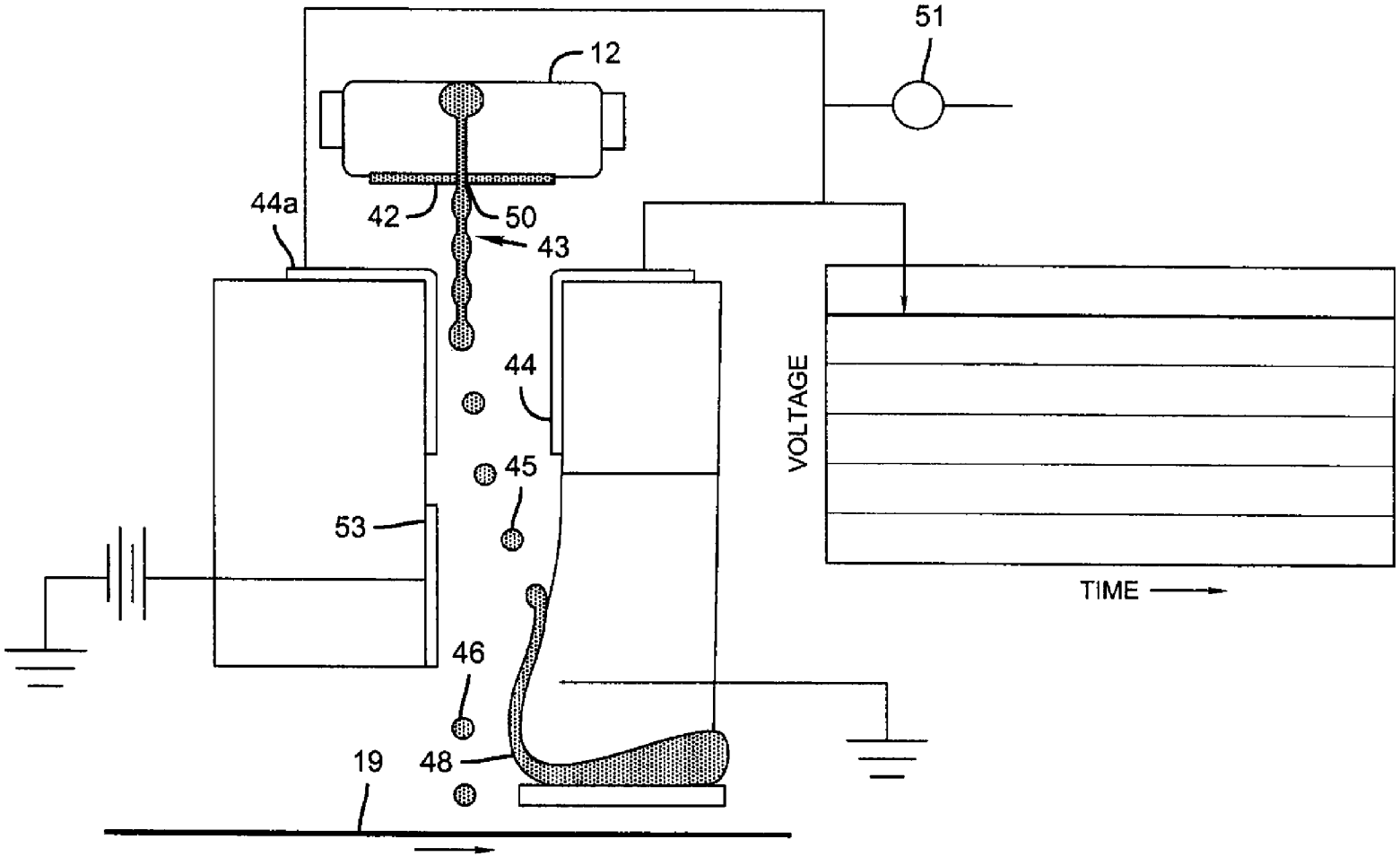

With reference now to FIGS. 5A and 5B there is illustrated a similar operation to that described with regard to FIGS. 4A and 4B except that in this embodiment the deflection mechanism also includes a second charge electrode 44*a* located on the opposite side of the jet array from the charge electrode 44. The second charge electrode 44*a* receives the same biasing from the charge source 51 as the charge electrode and is constantly held at the same potential as the charge electrode 44. The addition of a second charge electrode biased to the same potential as the charge electrode 44 produces a region between the charge electrode 44 and second charge electrode 44*a* with a very uniform electrode field. Placement of the droplet break off point between these charge electrodes makes the droplet charging and subsequent droplet deflection very insensitive to the small changes in break off position relative to the charge electrodes or in the electrode geometries. This configuration is therefore much more suitable for use with printheads having longer arrays of nozzles. The deflection mechanism also includes a deflection electrode 53. The voltage potential between the biased deflection electrode 53 and the catcher face produces an electric field through which the droplets must pass. Charged non-print droplets 45 are deflected by this electric field and moved along a trajectory so as to strike the catcher face 52. Non-charged print droplets 46 are substantially not deflected by this electric field and continue upon a trajectory for depositing upon the surface 19 for printing of an image.

Figure 6:
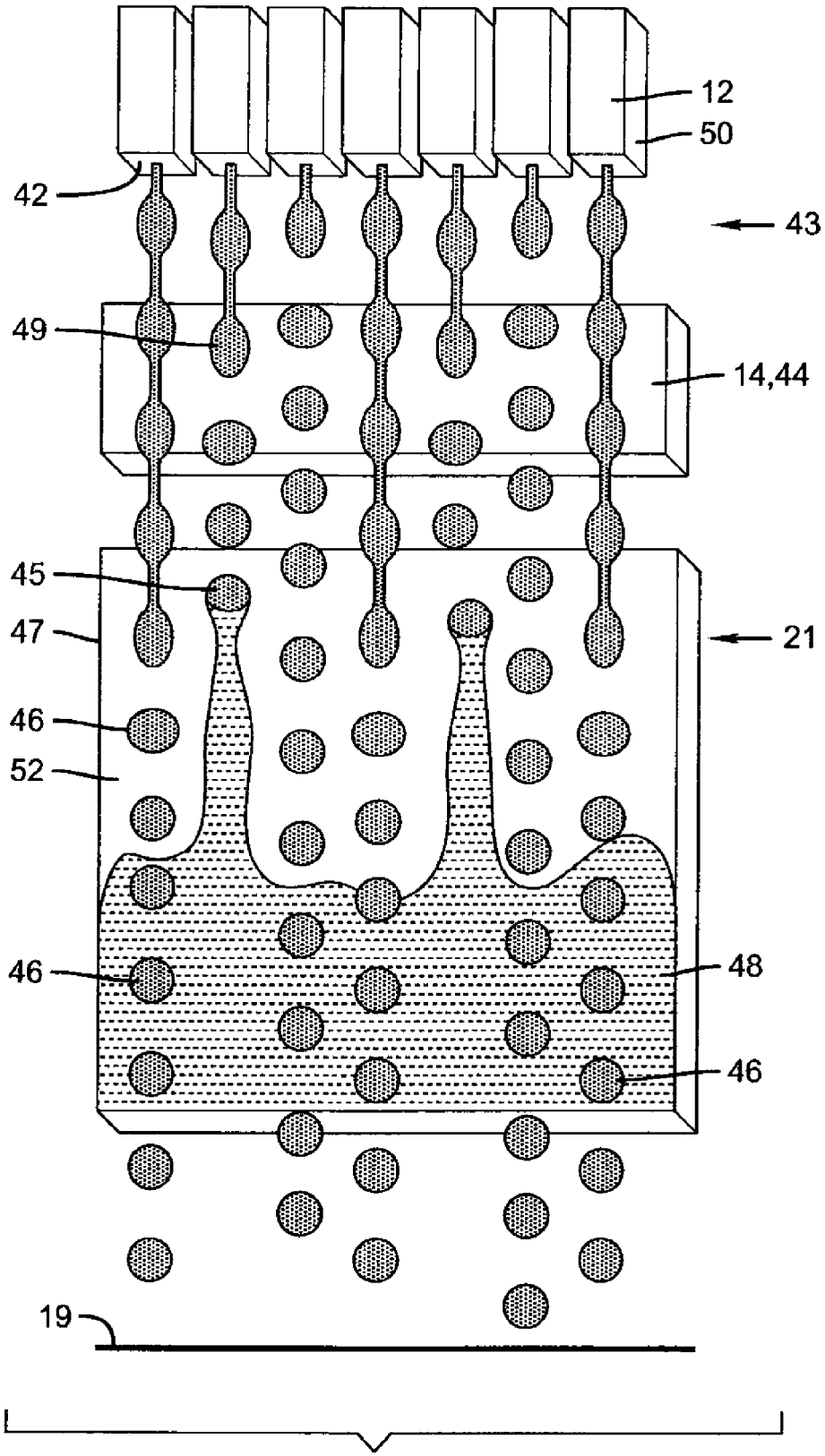
FIG. 6 illustrates a frontal view point of several liquid jets of the continuous inkjet printing system of the invention.

FIG. 6 illustrates a frontal view point of the CIJ printing system of the present invention along with several liquid jets. As shown previously, the printhead 12 has a stimulation device or droplet generator 42 that creates a liquid jet 43 from each nozzle 50. The liquid jets 43 break up into droplets off, above, or below the charge electrode 44. Those droplets that break off from the liquid jets at the charge electrode 44 will induce a charge onto those droplets 49 (as in jets #2 and #5 from left-to-right) while droplets from all other liquid jets remain uncharged. The uncharged droplets 46 travel past the charge electrode 44 and catcher face 52 of catcher 47 to impact onto the print substrate or recording medium 19. Charged droplets 45 will be deflected toward the catcher face 52 and create an ink film 48 on the face 52 of the catcher 47 and migrate downward toward the area for recycling. As seen in FIG. 6 the charge electrode 44 extends in a direction transverse to the jet streams so as to be common to and operative to charge droplets from at least a multiple number of these jet streams.

Figure 7A:
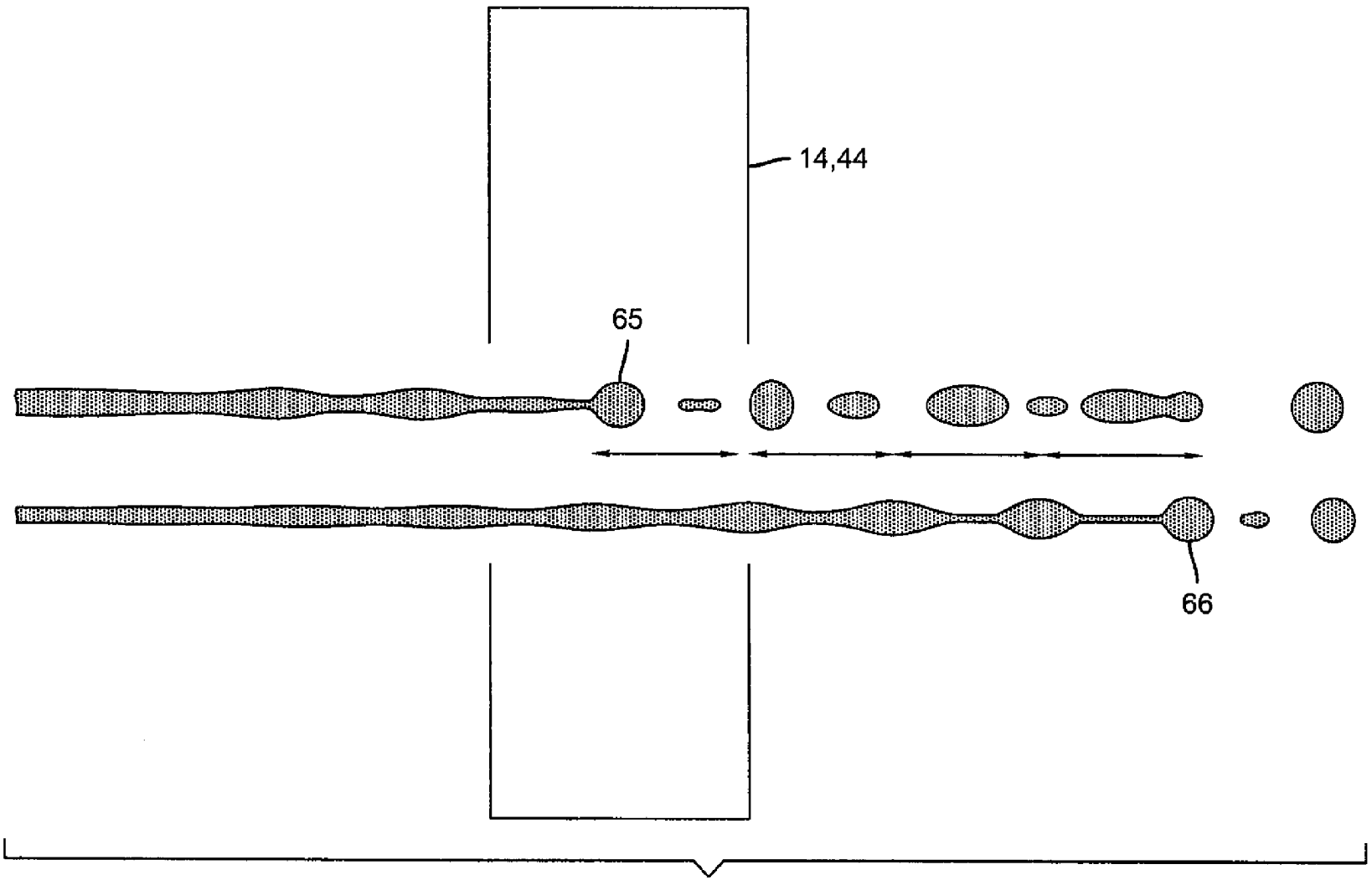
FIG. 7A illustrates the charge electrode placement in the continuous inkjet printing system of the invention and showing charging of the shorter break off length droplets and wherein the longer break off length droplets have a break off point that is about 4λ beyond the break off point of the shorter break off length droplets.
Figure 7B:
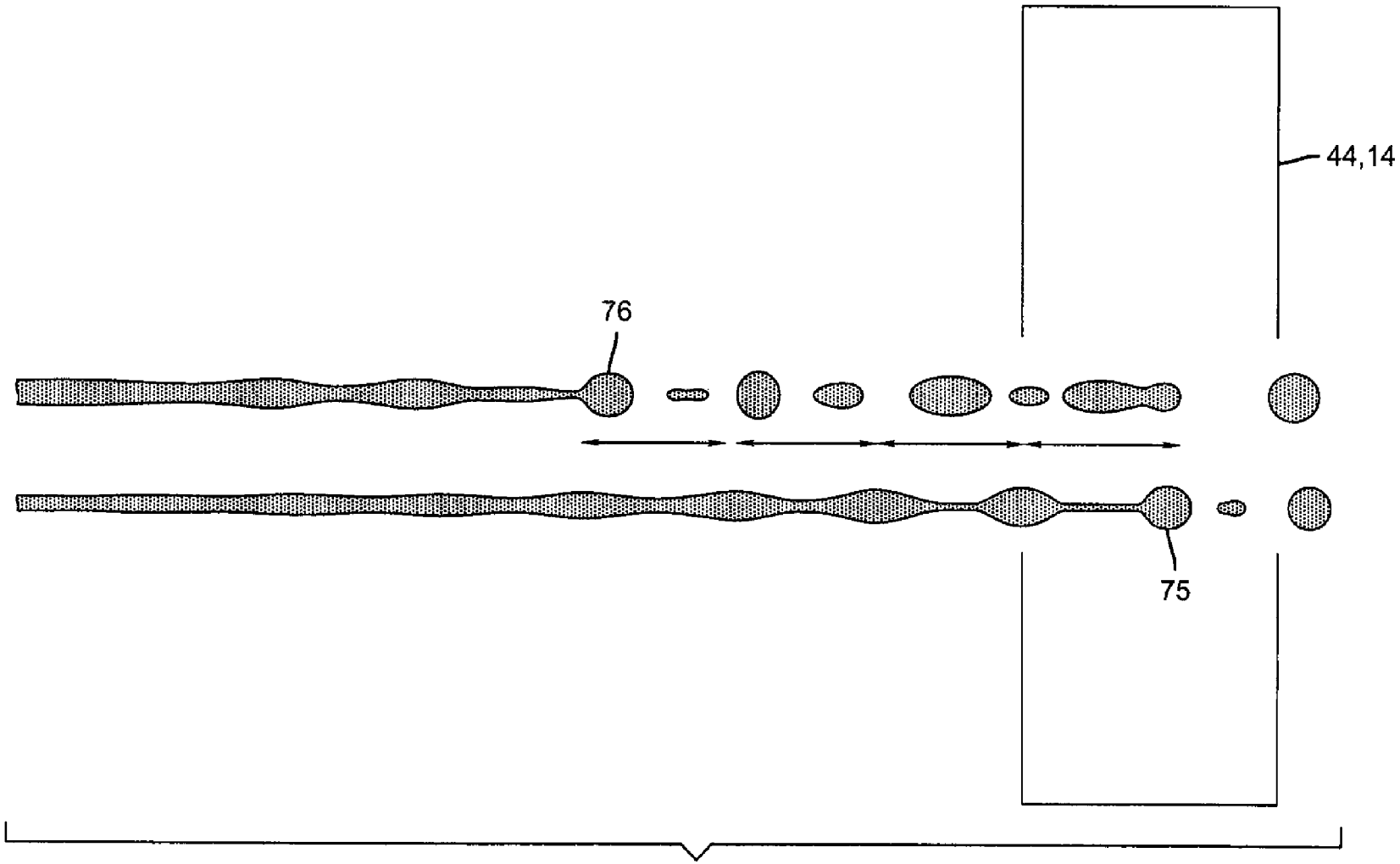
FIG. 7B is an alternative embodiment and illustrates the electrode or charge electrode placement in the continuous inkjet printing system of the invention and shows charging of the longer break off length droplets and wherein the longer break off length droplets have a break off point that is about 4λ beyond the break off point of the shorter break off length droplets.
Figure 7C:
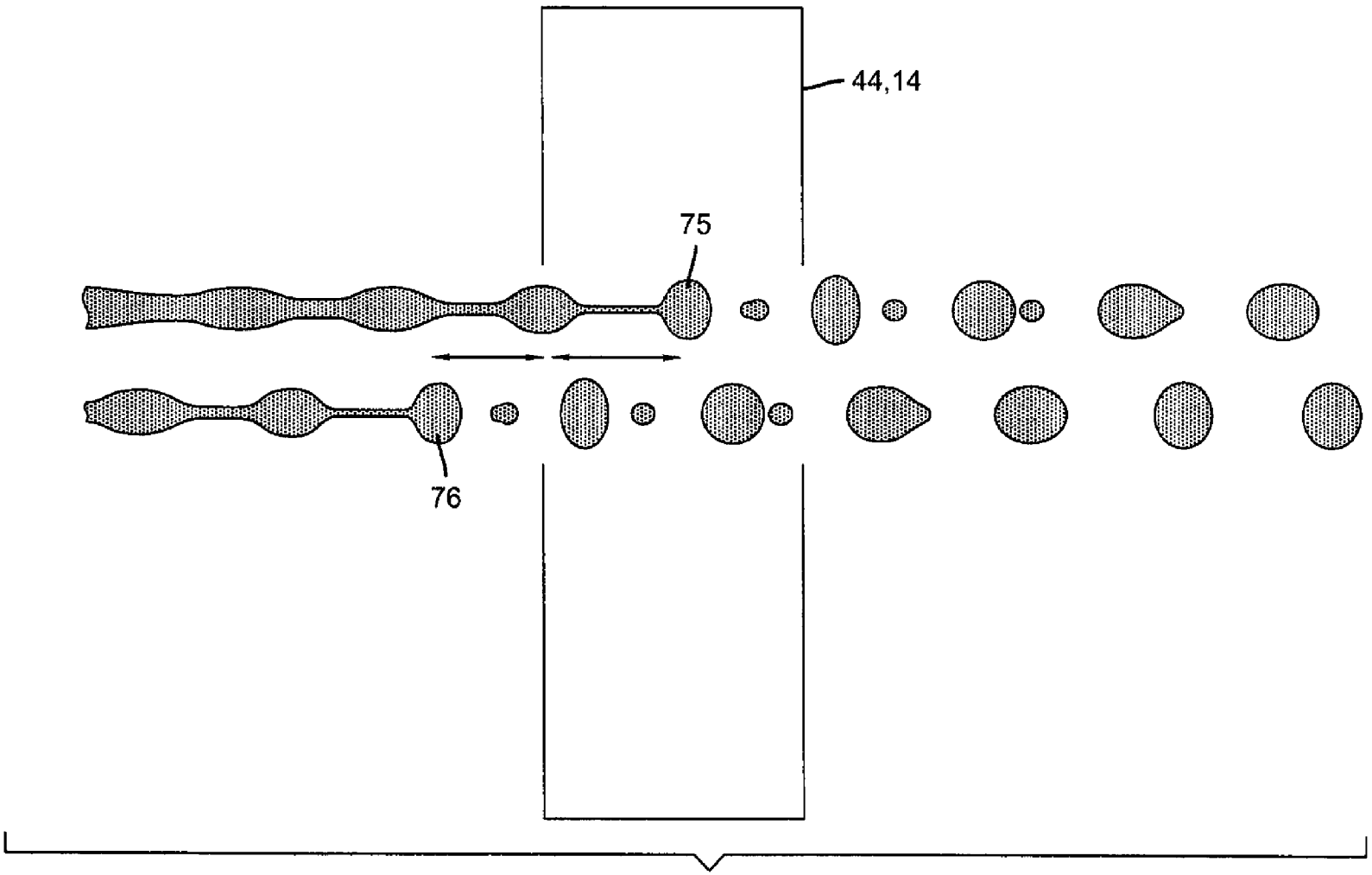
FIG. 7C is an additional alternative embodiment and illustrates the charge electrode placement in the continuous inkjet printing system of the invention and shows charging of the longer break off length droplets and wherein the longer break off length droplets have a break off point that is about 2λ beyond the break off point of the shorter break off length droplets.

FIGS. 7A, 7B and 7C also illustrate various embodiments of the present invention. In one embodiment (FIG. 7A), the shorter length droplet break off point occurs in front of the charge electrode 44 to create the charged/non-print droplets 65. The longer length droplet break off point occurs well beyond the charge electrode 44 creating uncharged/print droplets 66. In FIG. 7B, the charge electrode 44 has been placed farther from the nozzle orifice plate so that it is now located adjacent to the longer length droplet break off point. In this configuration, the longer break off length droplets 75 are charged while the shorter break off length droplets 76 are uncharged. In these two configurations, the shorter break off length droplets 76 break off from the liquid jet a distance 4λ prior to the break off of a longer break off length droplets 75. Here, the longer break of length results in the charged/non-print droplet. Smaller break off length differences are also possible for example, in FIG. 7C, the spacing of droplet break off points between the longer and shorter break of lengths is only 2λ but otherwise similar to FIG. 7B.

It should be noted that because of the fringing electric fields produced by the charge electrode 44 the droplets that don't breakoff in front of the charge plate 44 do acquire some charge as well. They are therefore not strictly uncharged.

They do however have much less charge than the droplets that break off in front of or adjacent to the charge electrode. A charge differential is therefore produced between the first liquid droplets having a first breakoff length and the second liquid droplets having a second break off length. As a result of the charge differential, the deflection mechanism causes the paths or trajectories of the first liquid droplets and the second liquid droplets to diverge. For descriptive simplicity, the term uncharged droplets is used in this specification for the droplets with significantly less charge.

It should be obvious, in view of the above description of the invention, to one skilled in the art that the charged droplets are not required to be the non-print droplets. Thus, the charged droplets may be the droplets that are printed while the non-charged droplets are the ones collected by the catcher. This is accomplished by positioning the catcher to intercept the path of the uncharged droplets rather than the path of the charged droplets.

Figure 8:
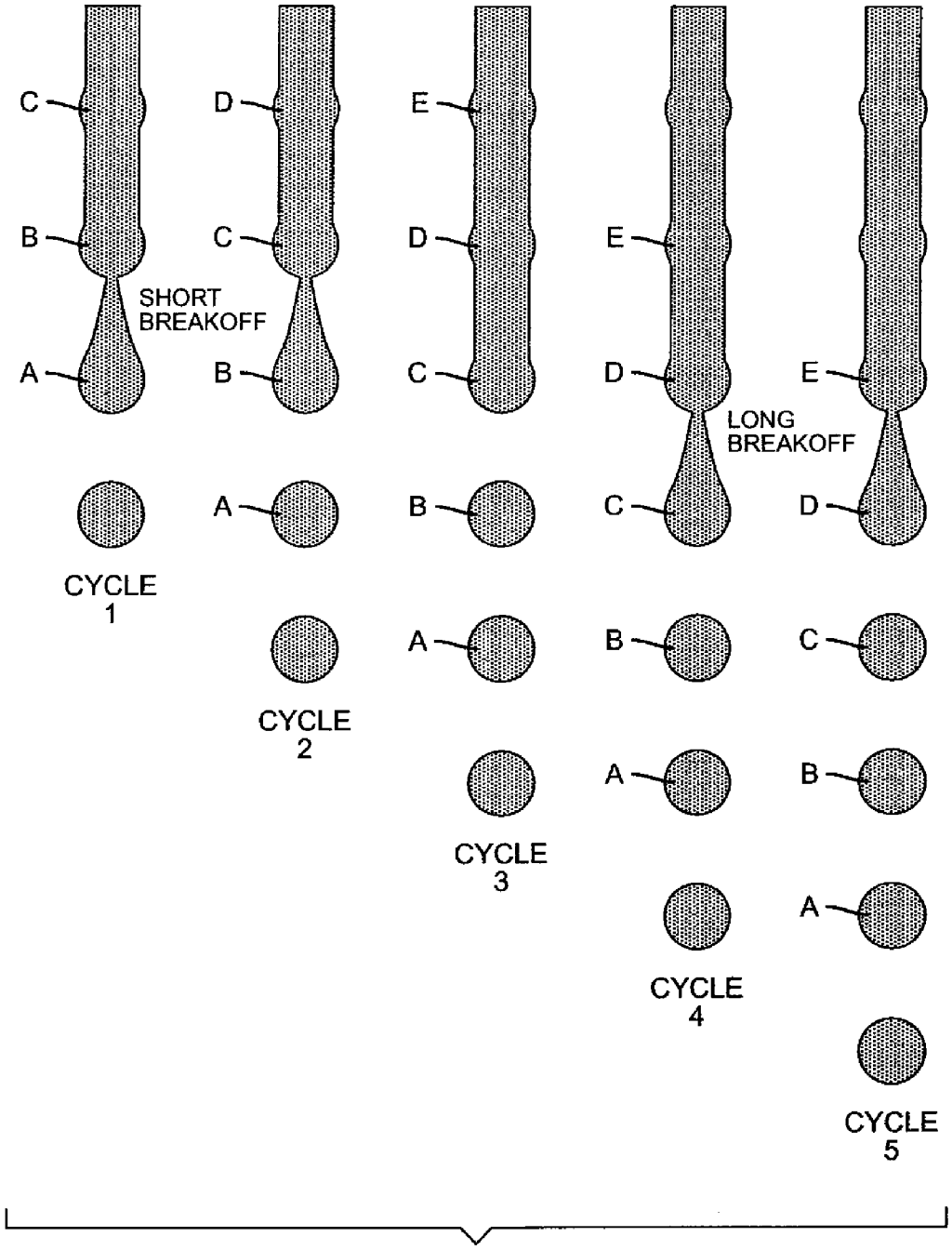
FIGS. 8, 9 and 10 illustrate a sequence of drop creations at a single nozzle in the continuous inkjet printing system of the invention.
Figure 9:
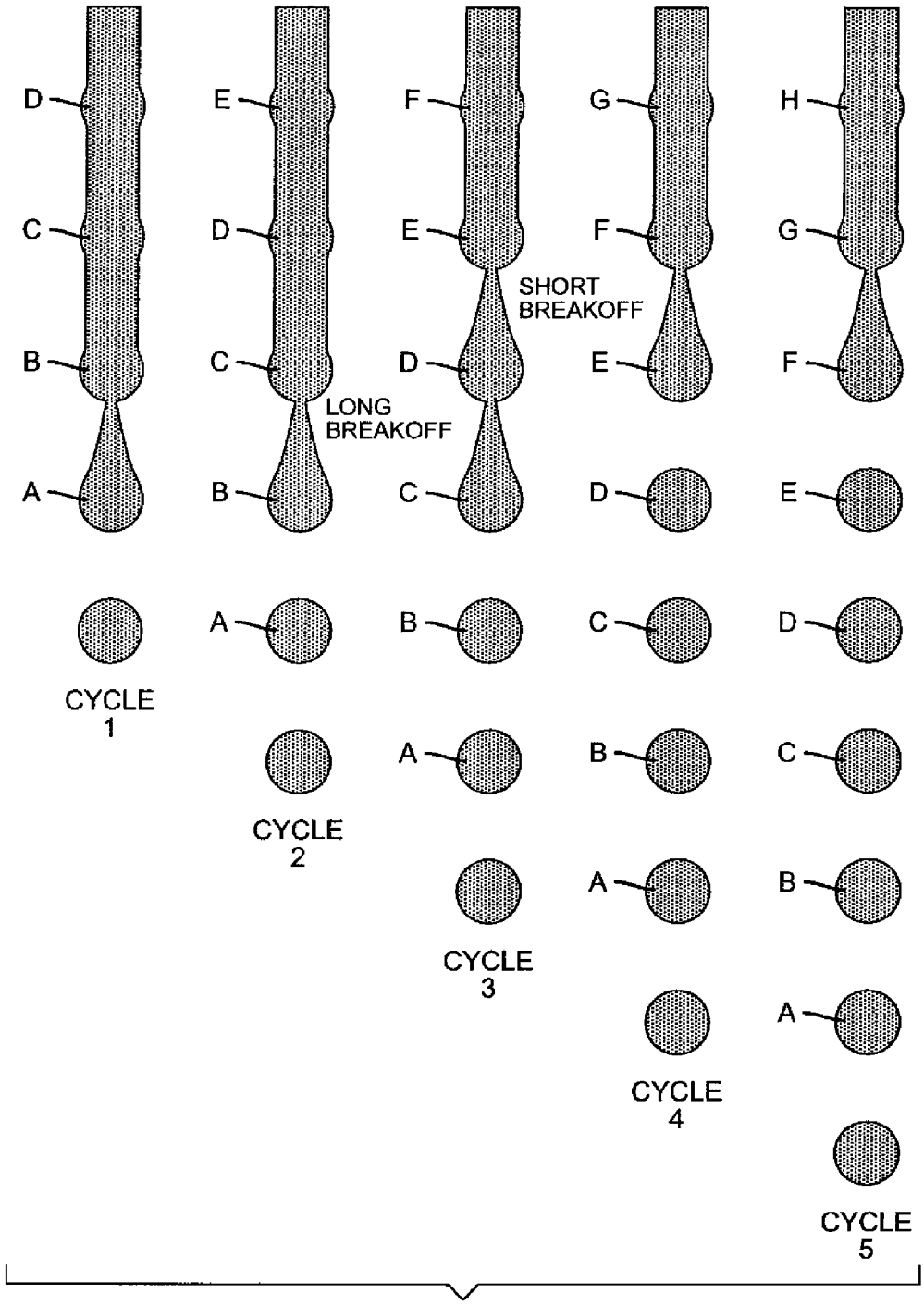
Figure 10:
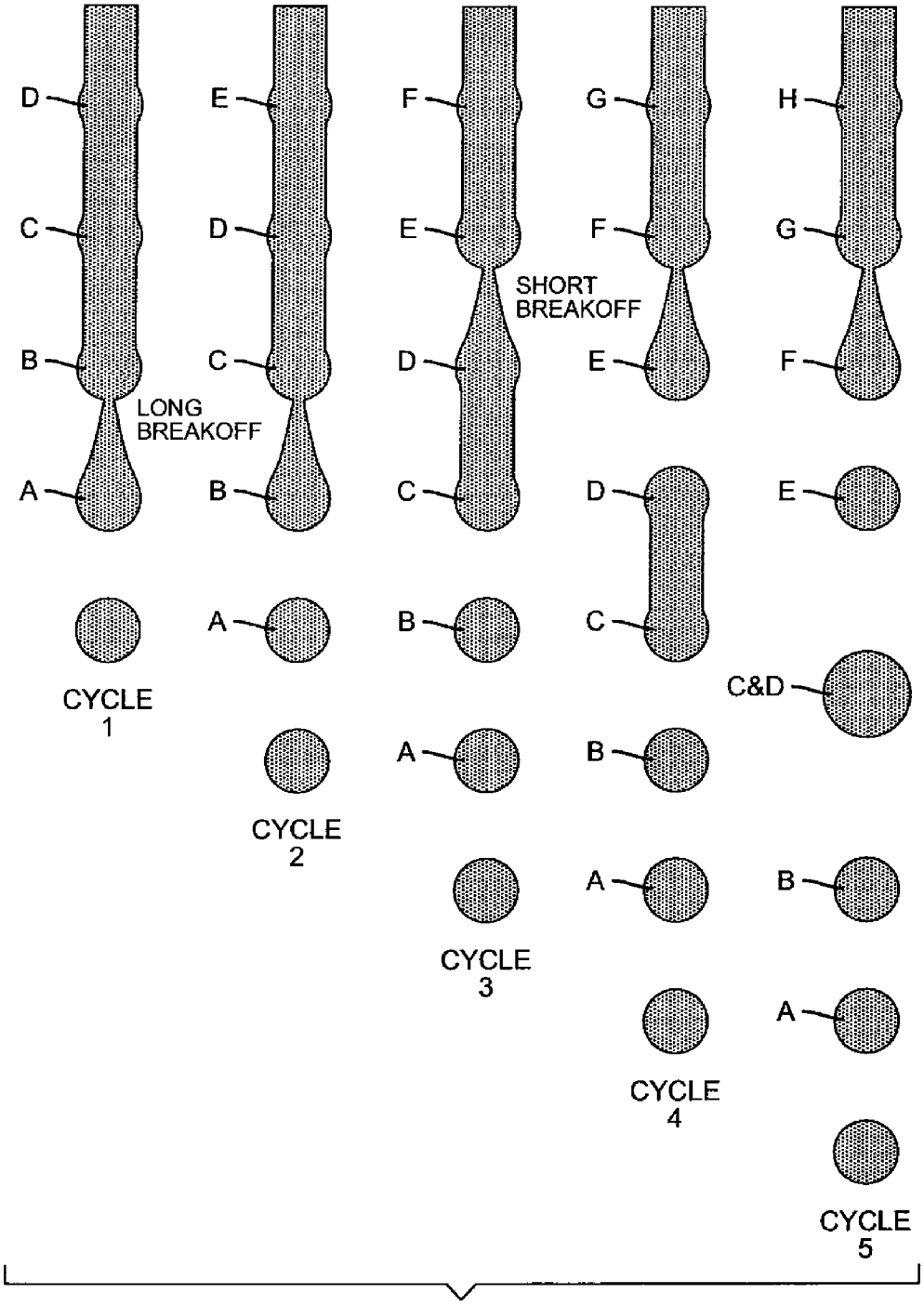

With reference now to FIGS. 8, 9 and 10 the different columns of drops correspond not to adjacent jets but to the same jet stream at consecutive stimulation periods. The letters associated with each of the droplets are in jet segments and label the particular blob of the ink showing the progression of the blob from one stimulation cycle to the next.

In FIG. 8 there is a transition from short break off length to longer break off length. For droplets A and B, short break off lengths were desired and produced. Droplets C, D and E were selected for long break off lengths. As a result of the transition and break off lengths no droplets break off in the third stimulation cycle. Ink blob C is seen to break off at stimulation cycle 4. Although during stimulation cycle 3 no drops were formed, the stimulation cycle 5 view shows that all drops were formed as desired; no drops are missing. If the charge electrode structure were positioned to charge the long break off length droplets but not the short break off length droplets there would not appear to be any problems at this transition.

Consider now the transition from long break off length droplets to short break off length droplets shown in FIG. 9. Here droplets A, B and C were selected to break off with long break off lengths and droplets D, E and F were selected to break off with short break off lengths. It may be seen in the third stimulation cycle that both the C and D droplets break off concurrently. This creates problems for drop selection. If droplet D breaks off from droplet E slightly before droplet C breaks off from droplet D, there is formed a C-D droplet that will break apart shortly thereafter. The total charge on this large ink blob is fixed once the ink filament breaks behind the D section. The charges on this C-D blob will be redistributed during the short time that it remains one blob. When this blob breaks apart, the droplets formed will each get a portion of the large blob's charge. The result is that the charges on the C and D droplets that are formed are not well defined. The outcome of this break off length transition is that charge and subsequent deflection of the transition droplets C and D will be different from the normal values for either the long break off length or the short break off length droplets. This is undesirable from a control standpoint.

Separate from the charging uncertainty, this long to short transition will have an impact on the drop velocity of the C and D droplets after they break apart from each other. Once the D droplet separates from the E droplets, surface tension of the fluid between the C and D droplets will accelerate the C and D blobs of ink toward each other. As a result the D droplet will have a higher velocity than the other short break off length droplets and the E droplet will have a lower velocity than other long break off length droplets. This is the same process that produces fast satellites in printers with normal stimulation cycles.

This indeterminate condition produced at a long break off to short break off transition can be overcome in accordance with the invention at least in part by an alternate drop break off transition. With reference to FIG. 10 as shown, no droplet separation inducing pulse, or stimulation pulse is created between the C and D blobs of ink as illustrated schematically by the column cycle 3. As a result, the C and D blobs of ink do not break up into separate droplets, but rather merge forming one larger droplet see column for cycle 4. The charge on the droplet will be the same as that trapped on the C and D droplet cluster as described above with reference to FIG. 9. As the two droplet blob doesn't break apart, the blob, called a large transition droplet, as a whole will be deflected in a well defined matter. It is expected that the charge on the large transition droplet will be slightly larger than that of the single long break off length droplets. As the large transition droplet has twice the mass of the normal droplet, the large transition droplet will follow a trajectory in which the drop deflection will be about half that of a normal long break off length droplets. Appropriate placement of the catcher to intercept the trajectory of the large transition droplet will enable this large transition droplet to be caught in addition to the normal non-print droplets. If the difference in break off length is greater than 2λ it may be necessary have more than one skip cycle in which no stimulation pulse is sent to the stimulation device by the stimulation controller.

Figure 11:
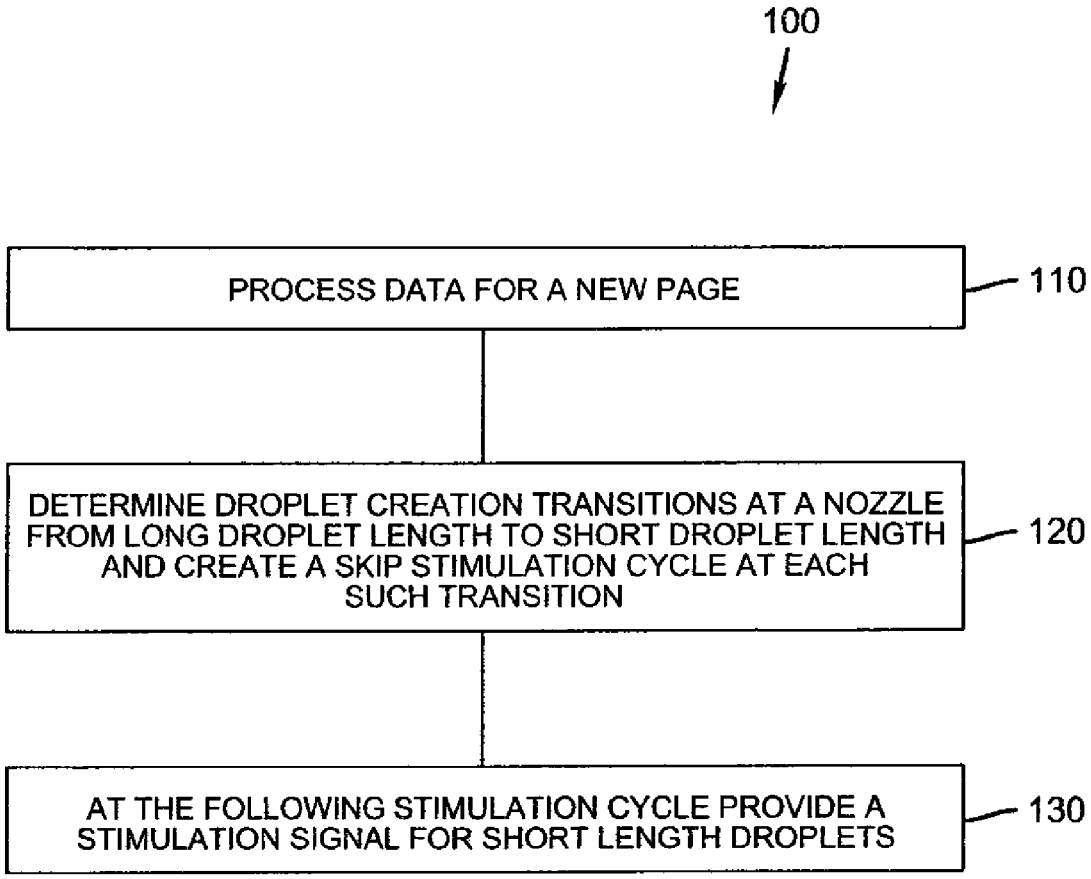
FIG. 11 is a flow chart illustrating one aspect of the invention.

With reference now to the flowchart 100 of FIG. 11 in step 110, data for a new page of image data is processed, for example, by a raster image processor (RIP) which determines from the image data those droplets which are to be printed and those droplets which are not to be printed; i.e. those which are to be caught by the catcher. It will be understood that the droplets will be distinguished by whether they are created as a long break off length droplet or a short break off length droplet. It will also be understood from the description above that in a particular printing system either the long break off length droplets or the short break off length droplets can be the droplets that are printed while the other is caught by the catcher. The RIP in step 120 analyzes the droplet selection signals that were established based on the image data and determines for each nozzle where a long break off length droplet is to be followed by a short break off length droplet. A tag is associated in a memory of the RIP wherever such a long-short transition is found. At the time that the stimulation controller would normally generate at the nozzle a stimulation pulse suitable for generating a short break off length droplet, the tag or other data provides an inhibit signal so that no stimulation pulse or at least an ineffectual stimulation signal is established or provided at the nozzle to skip generation for one stimulation cycle at that nozzle of a long or short break off length droplet, step 120. At the following stimulation cycle at that nozzle a stimulation signal appropriate for a short break off length droplet is provided, step 130. As noted above more than one skip cycle; i.e. two or more skip cycles, may be provided in a system where the difference in break off length between the long break off length droplet and the short break off droplet is equal to or greater than 2λ.

Figure 12:
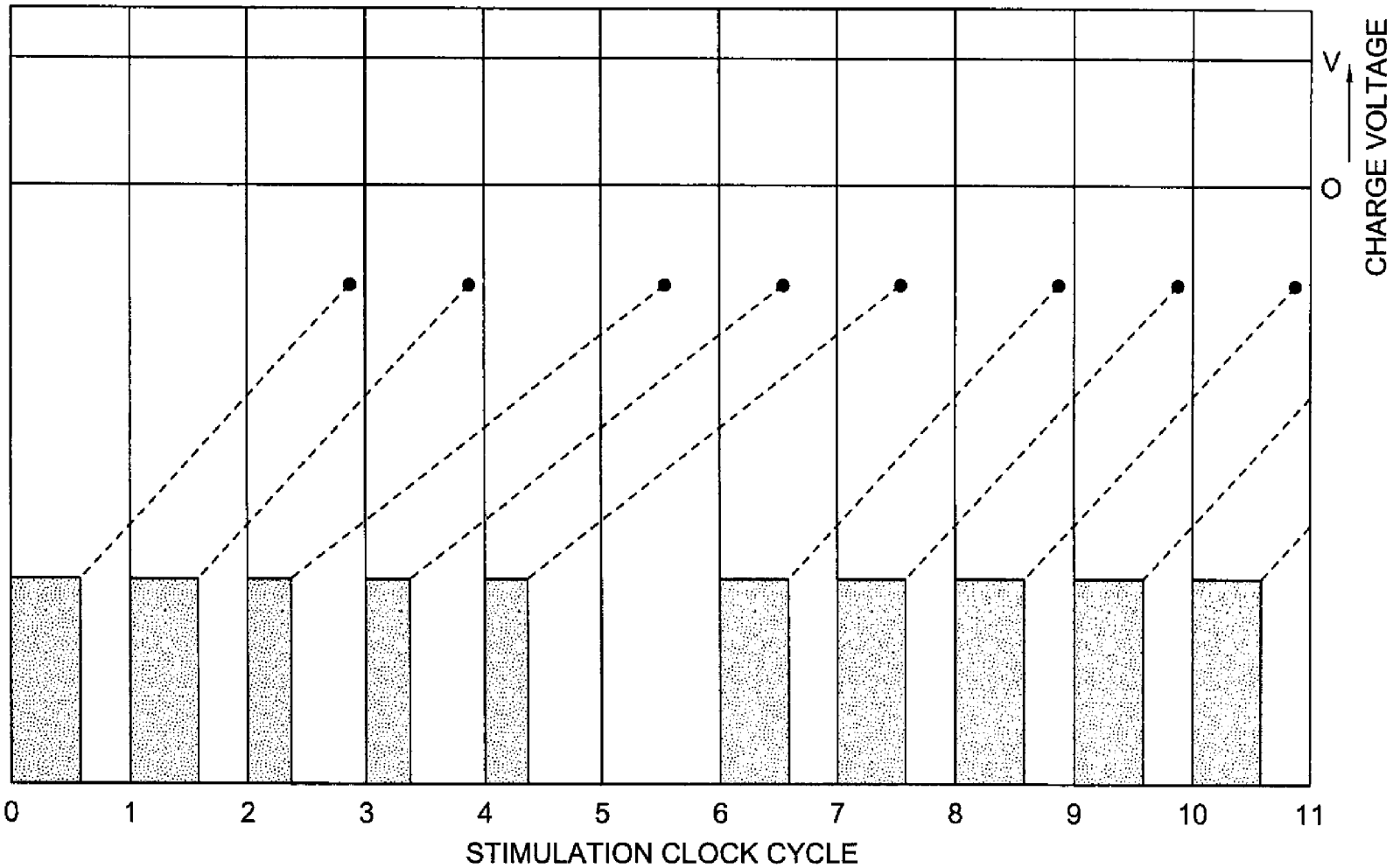
FIG. 12 is a chart illustrating stimulation clock pulses applied to a heater at a nozzle of the CIJ printing system of the invention and corresponding relative locations in time of the break off points of a respective droplet formed by its respective stimulation generating pulse. The chart also illustrates a uniform charge voltage V that is applied to a charge electrode.

With reference now to the chart of FIG. 12 there is illustrated schematically stimulation clock cycles for stimulating a nozzle to eject respective droplets. As may be seen between stimulation clock cycles 0-1, a relatively long-duration pulse at the nozzle heater creates a short break off length droplet at the nozzle indicated by the asterisk that is associated by the dotted line connection to the pulse. The location of the asterisk identifies the approximate break off time of that droplet associated with that stimulation pulse. Similarly, during stimulation clock cycle between 1-2 a relatively long-duration pulse at the nozzle heater creates a short break off length droplet at the nozzle. At stimulation clock cycles 2-3, 3-4 and 4-5 respective relatively short duration stimulation pulses at the nozzle heater generate respective long break off length droplets indicated by the respective asterisks connected by their respective dotted lines to the associated stimulation pulses. When a transition at a nozzle requires there to be a long break off length droplet to be followed by a short break off length droplet a skip cycle is introduced as indicated between stimulation clock cycle 5-6. It will be noted that between stimulation clock cycle 4-5 a short duration stimulation pulse will cause a long break of length droplet to be generated. Between clock cycle 6-7 a relatively long length pulse is provided that is suitable for a short break off length droplet creation. However, as noted above, a relatively larger volume droplet results whose charge can be established by controlling the location of its breaking off point. It thus can be seen that changes in the duty cycle or the width of the stimulation pulses supplied to the stimulation devices associated with the nozzles can be used to selectively control when a droplet created will be a long or short break off length droplet. Similarly, changes in the amplitude of stimulation pulses supplied to a stimulation device associated with the nozzle can be used to selectively control whether the droplet created will be a long or short break of droplet. In both of these cases (changing the duty cycle of the stimulation pulses or the amplitude of the stimulation pulses), the energy of the stimulation pulses are thereby varied producing changes in the break off lengths of the droplets. Also illustrated in FIG. 12 is an indication that a voltage or electrical potential V is applied to the charge electrode 44 and continued uniformly through the various stimulation clock cycles.

The stimulation pulse produces a slight wiggle or perturbation in the diameter of the liquid jet stream so that a portion of the stream is made slightly narrower than normal and another portion is made wider than normal. The perturbation will grow exponentially with time, the narrower section getting even narrower and the wider section getting even wider. The surface tension of the liquid produces a slight pressure difference in the stream causing liquid to move from the narrower region to the wider region. As the liquid stream is moving, the perturbation moves with the liquid stream. As the perturbation moves, eventually the diameter of the narrower region becomes zero and the droplet breaks off.

If the initial perturbation amplitude is made larger, by using higher amplitude stimulation pulses or longer stimulation pulses, less time is needed for the perturbation to grow to the point at which the droplet breaks off. Therefore the use of longer and shorter stimulation pulses as in FIG. 12 produces two different break off times.

While the invention has been described with reference to printing systems and methods it is also known to use inkjet droplet generating devices for decorating pastries and other three-dimensional articles or for forming three-dimensional articles by building up droplets of material on a substrate. The term ink in this application is therefore not limited to colored liquids for printing on paper, but is intended to also refer to liquids appropriate to other such applications. In addition while the stimulation pulses have been illustrated as a single rectangular pulse being provided during each cycle other waveforms can be employed, such as bursts of pulses, ramped pulses, sinusoidal pulses, and pulses of various polarities can also be used dependent on the type of stimulation device. While in the embodiments described the stimulation devices have comprised resistive elements, other types of drop stimulation including optical, piezoelectric, MEMS actuator, electrohydrodynamic, etc. or combinations thereof also may be substituted. Such applications and substitutions are all contemplated by this invention. The stimulation controller may be remote from the stimulation device, or it may be fabricated along with the stimulation device on a common component such as a nozzle plate. While the catcher shown in the illustrations is a Coanda type catcher, other catcher types, such as a knife edge catcher can also be employed. As noted above there is the advantage with the invention of use of a common charge electrode with plural nozzles. It will be understood that this does not limit the invention to all nozzles of a printhead being associated with one charge electrode. Thus, as an example only and not by way of limitation, the charge electrode may be associated with for example a set of 50 nozzles of the printhead and another charge electrode may be associated with a different set of 50 nozzles of that printhead.

The invention has been described in detail with particular reference to certain preferred embodiments thereof, but it will be understood that variations and modifications can be affected within the scope of the invention.

PARTS LIST

10 Continuous Inkjet Printing System
11 Ink Reservoir
12 Printhead
13 Image Source
14 Deflection Mechanism
15 Ink Recycling Unit
16 Image Processor
17 Logic Controller
18 Stimulation controller
19 Recoding Medium
20 Ink Pressure Regulator
21 Transport Control System
22 Transport Rollers
26 Liquid jet
27 Ink Droplets
30 Arrow (Lambda Spacing)
31 Truncated Arrow
35 Droplet
36 Droplet
38 Droplet
39 Droplet
42 Stimulation device Or Drop Generator
43 Liquid jet
44 Charge Electrode
**44*a*** Second Charge Electrode
45 Non-Print Droplet
46 Print Droplet Or Uncharged Droplets
47 Catcher
48 Ink Film
49 Droplets
50 Nozzle
51 Charging Potential Source
52 Catcher Face
53 Deflection Electrode
65 Charged/Non-Print Droplet
66 Longer Break Off Length Droplets
75 Longer Break Off Length Droplets
76 Shorter Break Off Length Droplets
100 Flowchart
110 Step
120 Step
130 Step

The invention claimed is:

1. A continuous inkjet droplet generating method for selectively depositing liquid droplets upon a surface, the method comprising:

producing a liquid jet through a nozzle;

operating a stimulation device associated with the liquid jet to produce, in response to stimulation pulses provided during stimulation cycles, a modulation in the liquid jet having a wavelength λ and causing a first liquid droplet to break off from the liquid jet and travel along a path and causing a second liquid droplet to break off from the liquid jet and travel along the path, the first liquid droplet having a first break off length, the second liquid droplet having a second break off length longer than the first break off length, the first break off length and the second break off length having a difference of at least one wavelength λ;

operating a deflection mechanism including a charge electrode associated with the path, the charge electrode producing a charge differential between the first liquid droplet and the second liquid droplet, and the deflection mechanism selectively attracting or repulsing ink droplets so that trajectories of the first liquid droplet and the second liquid droplet diverge so that a trajectory of one droplet of the first and second liquid droplets causes the one droplet to be directed for collection and prevented from depositing on the surface and a trajectory of the other droplet of said first and liquid droplets causes the other droplet to be directed for depositing on the surface; and identifying a transition in droplet creation between a stimulation cycle that is to produce a droplet having a second break off length and a stimulation cycle that is to produce a droplet having a first break off length and introducing a skip cycle between the stimulation cycle that is to produce the droplet having a second break off length and the stimulation cycle that is to produce the droplet having the first break off length.

2. The continuous inkjet droplet generating method of claim 1, wherein a catcher is positioned to intercept the trajectories of one of the first or second liquid droplets.

3. The continuous inkjet droplet generating method of claim 1, wherein no stimulation pulse is provided to the stimulation device during the skip cycle to form a large transition droplet.

4. The continuous inkjet droplet generating method of claim 3, wherein a catcher is positioned to intercept the trajectories of the large transition droplet.

5. The continuous inkjet droplet generating method of claim 1, wherein the charge electrode is continuously biased at a constant level relative to the liquid jet during droplet formation.

6. The continuous inkjet droplet generating method of claim 1, wherein the difference in break off length between the first break off length and the second break off length are produced by changes in at least one of the amplitude or duty cycle of stimulation pulses provided to the stimulation device.

7. The continuous inkjet droplet generating method of claim 1, wherein the first break off length and the second break off length have a difference of at least two wavelengths λ and during a transition in droplet creation between a stimulation cycle that is to produce a droplet having a second break off length and a stimulation cycle that is to produce a droplet having a first break off length there is introduced at least two skip cycles between the stimulation cycle that is to produce the droplet having a second break off length and the stimulation cycle that is to produce a droplet having the first break off length.

8. The continuous inkjet droplet generating method of claim 1, wherein the liquid droplets are comprised of ink for printing an image upon the surface.

9. The continuous inkjet droplet generating method of claim 1, wherein a plurality of nozzles associated produce a respective different liquid jet through each nozzle, a respective said stimulation device is associated with a respective each one of said nozzles and the stimulation device is operatively associated with a respective liquid jet, the stimulation device produces a modulation in the respective liquid jet having a wavelength λ and causing a first liquid droplet to break off from the liquid jet and travel along a path and causing a second liquid droplet to break off from the liquid jet and travel along the path, the first liquid droplet having a first break off length, the second liquid droplet having a second break off length longer than the first break off length, the first break off length and the second break off length having a difference of at least one wavelength λ in response to stimulation pulses; and wherein the charge electrode has common association with each of the different liquid jets and is operable with a respective liquid jet of each nozzle to produce a charge differential between the first liquid droplet and the second liquid droplet, and the deflection mechanism selectively attracts or repules ink droplets to cause trajectories of the first liquid droplet and the second liquid droplet from the respective liquid jet of each nozzle to diverge so that a trajectory of one droplet of the first and second liquid droplets causes the one droplet to be directed for collection and prevented from depositing on the surface and a trajectory of the other droplet of said first and liquid droplets causes the other droplet to be directed for depositing on the surface.

* * * * *